US005793019A

United States Patent [19]

Boyle et al.

[11] Patent Number: 5,793,019

[45] Date of Patent: Aug. 11, 1998

[54] ELECTRIC INFRA-RED AND FORCED AIR OVEN

[75] Inventors: David Frederick Boyle, Columbus; Thomas Alan Cherry; Gary Louis Solgere, both of Greensburg, all of Ind.

[73] Assignee: DriQuik, Inc., Greensburg, Ind.

[21] Appl. No.: 735,500

[22] Filed: Oct. 23, 1996

[51] Int. Cl.[6] ..... F24H 3/12; F26B 3/30; F26B 23/06; H05B 1/00

[52] U.S. Cl. ..... 219/400; 219/405; 219/411; 34/267; 34/270; 34/215; 392/375; 392/376

[58] Field of Search ..... 219/396, 399, 219/400, 405, 411; 99/474, 475, 477, 443 R, 443 C; 34/210, 267, 270, 215, 221, 225, 232, 233; 392/375, 376, 391

[56] References Cited

U.S. PATENT DOCUMENTS

| | | | |
|---|---|---|---|
| 1,490,960 | 4/1924 | Carduner | 392/375 |
| 1,515,731 | 11/1924 | Cole | 392/375 |
| 1,846,233 | 2/1932 | Van Daam | 392/376 |
| 2,727,978 | 12/1955 | Beckett et al. | 392/376 |
| 3,571,939 | 3/1971 | Paul | 34/233 |
| 4,164,642 | 8/1979 | Ebert | 392/375 |
| 4,706,736 | 11/1987 | Gyori | 219/400 |
| 4,781,169 | 11/1988 | Henke et al. | 99/443 C |
| 4,835,367 | 5/1989 | Hoffman | 392/376 |
| 4,870,255 | 9/1989 | Fujii et al. | 219/400 |
| 4,987,290 | 1/1991 | Okuno | 392/375 |
| 5,404,420 | 4/1995 | Song | 219/400 |
| 5,456,023 | 10/1995 | Farnan | 34/270 |
| 5,606,805 | 3/1997 | Meyer | 34/267 |

FOREIGN PATENT DOCUMENTS

| | | | |
|---|---|---|---|
| 53-93650 | 8/1978 | Japan | 392/376 |

*Primary Examiner*—Teresa J. Walberg
*Assistant Examiner*—J. Pelham
*Attorney, Agent, or Firm*—Barnes, Kisselle, Raisch, Choate, Whittemore & Hulbert, P.C.

[57] ABSTRACT

An infra-red and forced air oven for drying a freshly painted object. The drying oven has a plurality of heating elements, which radiate infra-red energy, disposed about the object to be dried. Each heating element preferably has an annular shell, an electrically conductive coil carried by the shell, and an air passage through the shell through which air is forced by a fan. Electricity is provided to the electrically conductive coil which becomes heated and thereby heats the shell and radiates heat and infra-red energy into the oven. The fan forces air through the air passage of the shell so that heated air flows to the interior of the oven. Thus, the oven provides both radiant energy and forced air to dry an object within the oven.

15 Claims, 2 Drawing Sheets

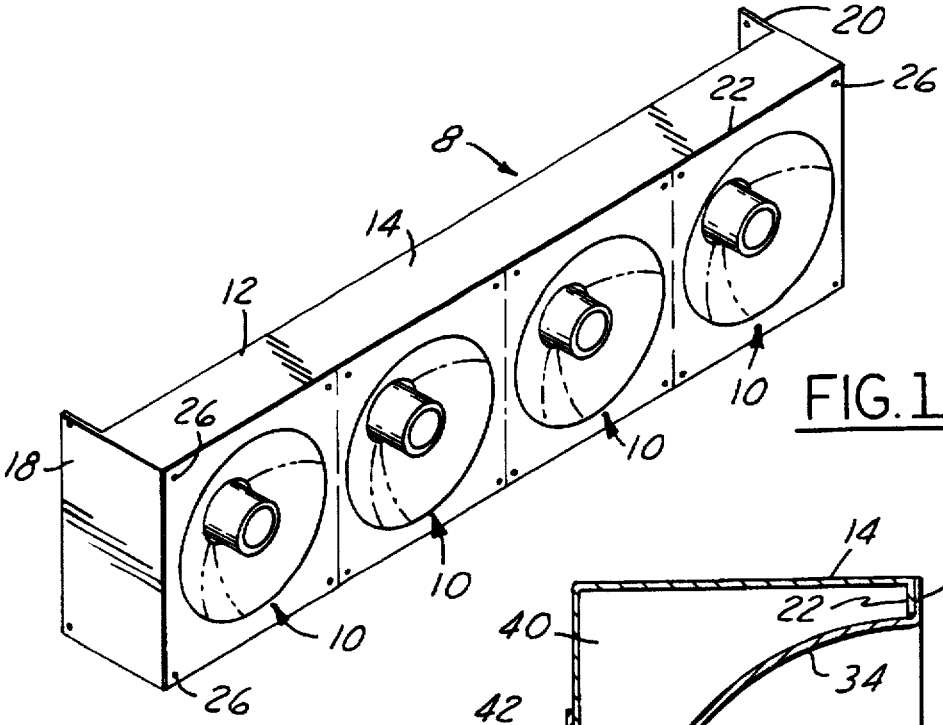
FIG. 1
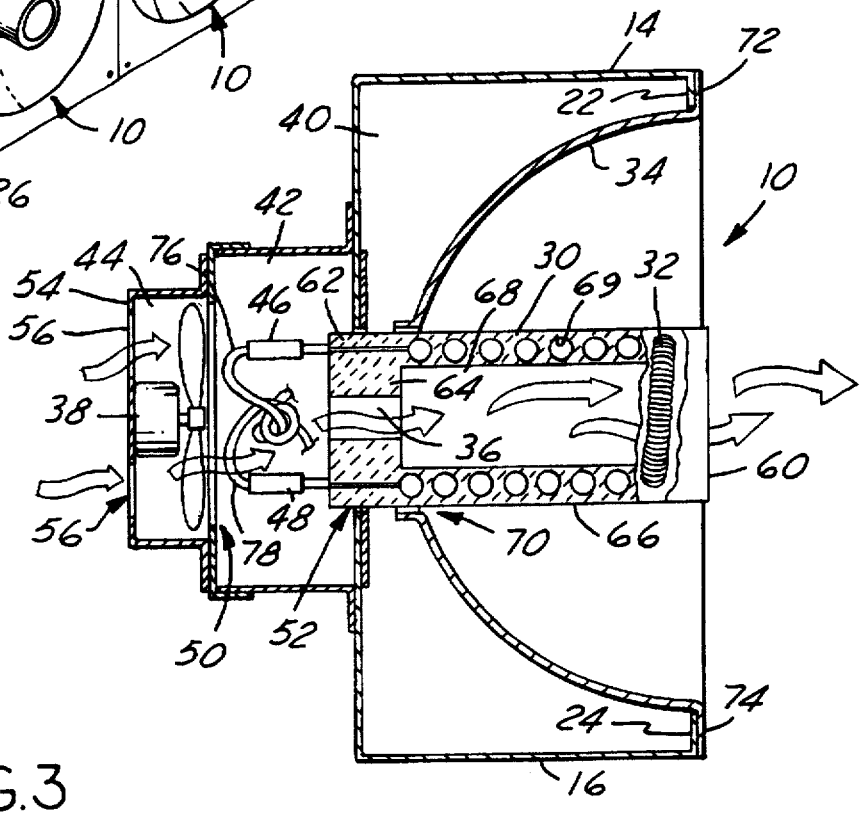
FIG. 2
FIG. 3
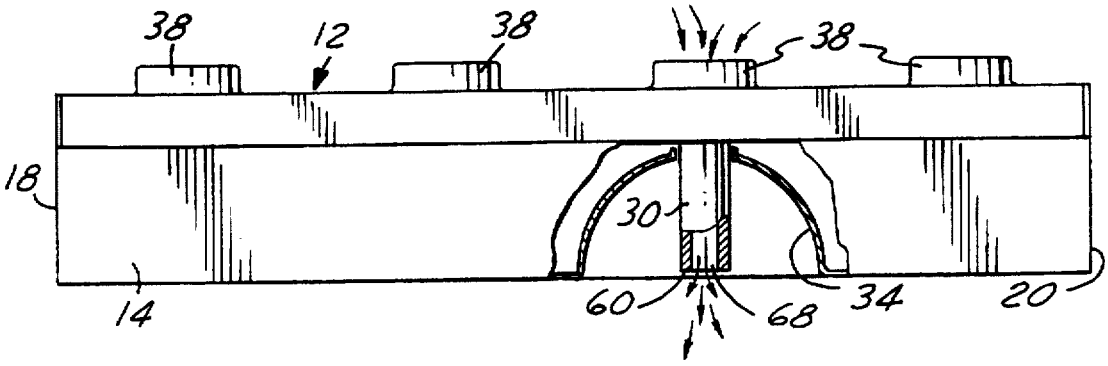

ELECTRIC INFRA-RED AND FORCED AIR OVEN

FIELD OF THE INVENTION

This invention relates to drying ovens and more particularly to electric infra-red drying ovens.

BACKGROUND OF THE INVENTION

It is well known to dry freshly painted objects in a drying oven utilizing infra-red energy that radiates from electric heating elements within the drying oven. Typical heating elements have an electrically conductive coil which becomes heated when an electrical current is passed through it. The infra-red energy radiates from the electrical coil towards the interior of the drying oven and the freshly painted object is dried therein. However, relying solely on radiant energy from the heating element is inefficient, produces uneven drying and can require an unnecessarily long drying time as areas not directly contacted by the infra-red radiation dry more slowly than areas directly contacted.

SUMMARY OF THE INVENTION

An electric infra-red and forced hot air oven with a plurality of heater elements. Each heater element has an annular shell with an electrically conductive coil and an air passage through which a fan forces air to the interior of the drying oven. Preferably, the annular shell encloses the electrically conductive coil and is open at one end to the interior of the oven and has a wall at the opposite end of the shell. Preferably, the air passage through the shell is provided in the end wall of the shell so that the air forced through the air passage by the fan moves through the entire length of the interior of the shell before entering the interior of the drying oven.

When an electric current is passed through the electrically conductive coil, the coil and shell become heated and radiate infra-red energy toward the object to be dried in the oven. At the same time, the fan forces air through the air passage and the shell and then into the interior of the oven. This heats the air and creates air currents within the oven that help to dry even those areas of the object to be dried not directly contacted by infra-red radiation. Thus, in addition to the radiant energy provided by the electric heating elements the flow of hot air within the oven, due to the fans forcing air through the heating elements, helps to more evenly, rapidly and efficiently dry the object within the oven.

Objects, features and advantages of this invention include providing infra-red heating elements and an oven that drys a freshly painted object with both radiant energy and forced hot air, reduces the time necessary to dry a freshly painted object, more uniformly dries a freshly painted object, provides a more controlled environment within the oven, is more efficient, more effective for water-based paints, simple, stable, reliable, of relatively simple design and economical manufacture and assembly and has a long useful life in service.

BRIEF DESCRIPTION OF THE DRAWINGS

These and other objects, features and advantages of this invention will be apparent from the following detailed description of the preferred embodiments and best mode, a claims and accompanying drawings in which:

FIG. 1 is a perspective view of an oven module with four heating elements adjacent to each other and carried by a housing;

FIG. 2 is a sectional view illustrating a fan adjacent the rear of the heating element and the air passage;

FIG. 3 is a partial sectional view illustrating a heating element with an air passage therethrough and a fan forcing air through the air passage according to the present invention.

DETAILED DESCRIPTION OF THE PREFERRED EMBODIMENTS

Figure 4:
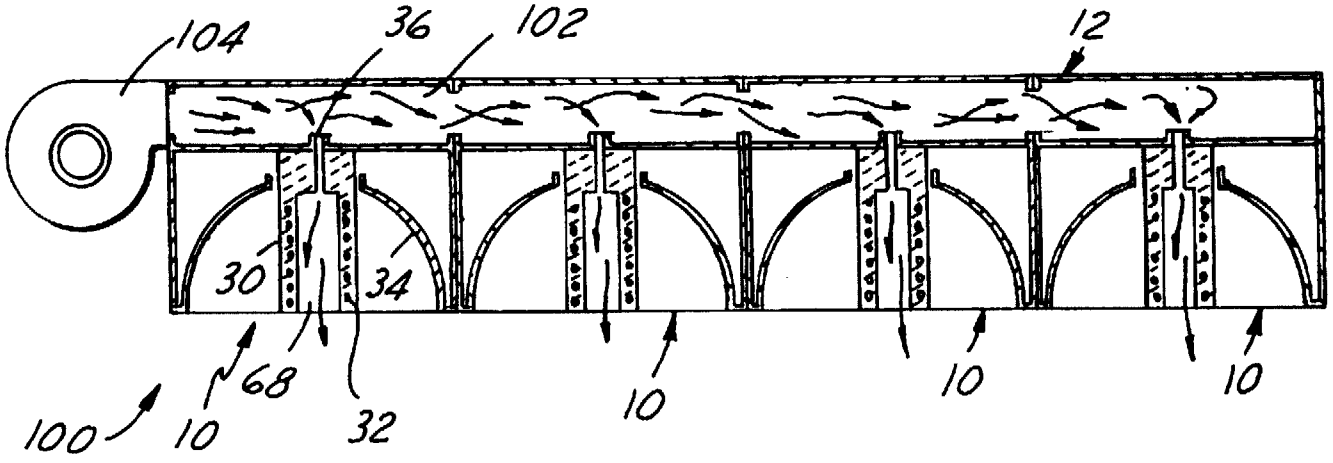
FIG. 4 is a schematic view of an alternate embodiment having a single fan which forces air through four adjacent heating elements.

Referring in more detail to the drawings, FIG. 1 shows an oven module 8 with several heating elements 10 carried adjacent to each other by a housing 12. The housing 12 is preferably made of metal and has generally opposed top 14 and bottom walls 16, and two generally opposed end walls 18, 20 by which the housing 12 can be securely mounted in a drying oven preferably within and adjacent to the exterior insulating walls of the drying oven. Preferably, reflectors 34 for the heating elements 10 are secured adjacent the front edge 22, 24, of the top 14 and bottom walls 16 by screws 26, rivets or other suitable mechanical fasteners. Preferably, several modules 8 are disposed in the oven evenly spaced about the surfaces to be dried of the objects disposed in or passing through the oven to throughly and substantially evenly dry the fresh paint or other coating on the objects within the oven.

As shown in FIG. 2, each heating element 10 has an annular shell 30, an electrically conductive coil 32 carried by the shell 30, a reflector 34 carried by the housing 12 adjacent to the shell 30, and an air passage 36 through the shell 30. Each heating element 10 projects through a reflector 34 and an associated fan 38 carried by the housing 12 forces air through the adjacent air passage 36 of the shell 30. The housing 12 is preferably divided into first 40, second 42 and third 44 chambers. The first chamber 40 carries the reflector 34 and shell 30, the second chamber 42 encloses the back end of the shell 30 and the ends 46, 48 of the coil 32 extending from the shell 30 and the third chamber 44 carries the fan 38. To communicate the fan 38 with the air passage 36, a first opening 50 is provided between the second and third chambers 42, 44, and the shell projects into the second chamber 44 through a second opening 52. So that air within the oven can be drawn through the fan, openings 56 are provided through the back 54 of the third chamber 44.

Preferably, the front 60 of the shell 30 is open to the interior of the oven and the back 62 of the shell 30 is at least partially closed by a wall 64. Preferably, the shell 30 has a cylindrical and tubular side wall 66 providing a passage 68 therein and is thick enough to completely receive the coil 32 in a helical passage 69 therein. The side wall 66 extends generally longitudinally of the heating element and its length, along with its tubular construction, provides increased surface area from which heat and infra-red energy radiate and increases the heating of the air forced through the shell 30. To be able to withstand high temperatures over extended periods of time, to provide a good infra-red energy radiator, and to resist degradation due to moisture or vibrations, the shell 30 is preferably formed from a ceramic material.

The electrically conductive coil 32 is preferably a metallic, electrically conductive wire tightly wound to form a helix with individual loops having substantially the same diameter. The coil 32 is preferably wrapped around substantially the entire length of the side wall 66 of the shell 30 and more preferably the coil 32 is integrally molded within the side wall 66 of the shell 30 as shown in FIG. 2. Also preferably, the ends 46, 48 of the coil 32 extend through the wall 64 adjacent the back 62 of the shell 30 and are connected by insulated lead wires 76 and 78 to an electric power supply to provide electric current to the coil 32.

Preferably, the reflectors 34 are generally semi-spherical, concave, face towards the interior of the oven and have an opening 70 constructed to receive the shell 30 through the center of the reflector 34. The reflectors 34 preferably have generally opposed top and bottom edges 72, 74 which overlie and are attached to the front edge 22, 24 of the top 14 and bottom 16 walls of the housing 12. To direct infra-red radiation toward the interior of the oven, the reflectors 34 are disposed adjacent to the heating elements 10 and are angled and directed towards the interior of the oven. To be able to withstand high heat and to effectively reflect infra-red radiation, the reflectors 34 are preferably formed of a polished metal and more preferably, of aluminum or stainless steel. The reflectors 34 direct the infra-red energy away from the exterior walls of the oven toward the object to be dried.

In accordance with the present invention, an air passage 36 is provided through the shell 30 and a fan 38 is carried by the housing 12 adjacent to and in communication with the air passage 36 to force air through the air passage 36 and the shell 30 and into the interior of the oven. To allow the fan 38 to be positioned behind the heating element 10 and so that the air moved by the fan 38 travels the entire length of the side wall 66 and can be heated by the hot coil 32 and shell 30, the air passage 36 is preferably formed in the end wall 64 adjacent to the back 62 of the shell 30. Preferably, the air passage 36 is substantially concentric with the axis of the side wall 66 of the shell 30.

Preferably, as shown in FIG. 3, one fan 38 is disposed adjacent each heating element 10 and forces air directly through that heating element 10. The air is drawn from outside of the housing 12 by the fan 38 which then forces the air through the air passage 36, the passage 68 of the shell 30 and into the interior of the oven. In an alternate embodiment 100, as shown in FIG. 4, the housing 12 is provided with an internal passage 102 which is in communication with the air passage 36 of all four of the heating elements 10 and with a single fan 104. In this embodiment, the fan 104 forces air through the internal passage 102 of the housing 12 thereby forcing air through the air passages 36 of each of the four heating elements 10 and into the interior of the oven.

Preferably, the output of the fans 38 or 104 can be varied to control the air currents produced within the oven and to aid in controlling the temperature of the air within the oven. Preferably, the fans are controlled by a computer or programable controller which monitors the operational parameters of the oven and can turn the fans on and off or vary the operating speed of the fans and vary the current supplied to the coils 32 of the heating elements to control the environment within the oven.

In use, a freshly painted object is placed in or conveyed through the interior of a drying oven having a plurality of heating modules 8 according to the present invention. An electric current is supplied to the coils 32 of the heating elements 10 which become heated thereby heating the shells 30 and radiating heat and infra-red energy into the oven. The reflectors 34 help to direct the infra-red energy away from the walls of the oven and towards the object to be dried within the oven. In addition, the fan 104 or fans 38 adjacent to the heating element 10 force air through the air passage 36 and shell 30 of each heating element 10 and into the interior of the oven creating currents of heated air within the oven that help to dry the object within the oven. The forced air currents within the oven help to dry even those areas of the object within the oven that are not directly contacted by the infra-red radiation. The forced air circulation also provides a more uniform air temperature within the oven which provides more uniform heating of the painted or coated surfaces to be dried. The forced air circulation also decreases the operating temperature of the shell which produces more longer wave length infrared radiation which is desirable for drying some paints and other coatings and increases the useful service life of the coil and the shell. Thus, heating elements 10 according to the present invention provide both radiant energy and forced heated air to the object to be dried to more evenly and more efficiently dry the object.

We claim:

1. In a drying oven, an infra-red heating element comprising:

an oven housing, a shell of a ceramic material with a circumferentially continuous tubular sidewall defining a single open interior space with an open end communicating to the oven and a helical passage within the sidewall, the shell being received in the oven housing;

an electrically conductive heater coil received within the helical passage and carried by the shell;

an air passage through the shell communicating with the interior space of the sidewall of the shell at a point remote from its open end for discharging forced air through the interior space across substantially the entire length of the sidewall and through the open end into the interior of the oven housing; and a fan communicating with the air passage so that when the heater coil is energized the fan operates to force air through the air passage and the interior space of the sidewall of the shell so that heated air flows into the interior of the oven housing and the shell radiates radiant energy into the interior of the oven housing.

2. The heating element of claim 1 wherein a housing carries at least one heating element and at least one fan.

3. The heating element of claim 2 wherein one fan is provided adjacent each shell.

4. The heating element of claim 2 wherein the housing carries more than one heating element and has a passage in communication with the air passage of each shell and at least one fan communicates with the passage.

5. The heating element of claim 4 wherein one fan is in communication with the passage and all the air passages of all the shells.

6. The heating element of claim 1 wherein the shell also comprises an end wall closing the other end of the tubular sidewall with the air passage opening through the end wall to the interior space of the sidewall.

7. The heating element of claim 6 wherein the air passage is concentric with the side wall.

8. The heating element of claim 6 wherein the shell also comprises an end wall extending across the sidewall immediately adjacent to the an end of the sidewall distal from the open end of the sidewall and the air passage is formed through said end wall.

9. The heating element of claim 1 wherein a reflector is disposed adjacent the shell and directed towards the interior of the oven.

10. The heating element of claim 1 wherein the shell is formed of a ceramic material.

11. An infra-red heating element for an infra-red drying oven comprising:

a shell of a ceramic material with a circumferentially continuous tubular sidewall defining a single open interior space with an open end communicating with the oven;

an electrically conductive heater coil received within the helical passge in the sidewall and carried by the shell; and an air passage through the shell communicating with the interior space of the sidewall of the shell at a point remote from its open end for discharging forced air through the interior space across substantially the entire length of the sidewall and through the open end into the oven so that when the heater coil is energized the air forced through the interior space of the shell is heated and flows into the oven and the shell radiates radiant energy into the oven.

12. The heating element of claim 11 wherein a reflector is disposed adjacent the shell and directed towards the interior of the oven.

13. The heating element of claim 11 wherein the shell has an annular sidewall with the air passage opening to the interior of the side wall.

14. The heating element of claim 13 wherein the air passage is concentric with the side wall.

15. The heating element of claim 13 wherein the shell also comprises an end wall extending across the sidewall immediately adjacent to an end of the sidewall distal from the open end of the sidewall and the air passage is formed through said end wall.

* * * * *